US005105941A

United States Patent [19]

Dolan et al.

[11] Patent Number: 5,105,941

[45] Date of Patent: Apr. 21, 1992

[54] SAMPLE PACKET NEWSPAPER INSERT

[75] Inventors: Colleen H. Dolan, Chicago, Ill.; Arnold R. Behrman, Morganville, N.J.; Barry G. Seelig, Tuxedo Park, N.Y.

[73] Assignee: Chicago Tribune Company, Chicago, Ill.

[21] Appl. No.: 504,965

[22] Filed: Apr. 5, 1990

[51] Int. Cl.[5] ..... B65D 73/00; G09F 5/04

[52] U.S. Cl. ..... 206/232; 132/317; 206/823; 283/56

[58] Field of Search ..... 206/232, 229, 581, 823; 132/314, 317, 319, 320; 283/56; 434/377

[56] References Cited

U.S. PATENT DOCUMENTS

| | | | |
|---|---|---|---|
| 885,778 | 4/1908 | Neuberger | 206/56 |
| 1,580,830 | 4/1926 | Lengel | 283/117 |
| 1,868,399 | 7/1932 | Sklezak | 206/229 |
| 1,885,076 | 10/1932 | Bustamante | 206/229 |
| 2,069,332 | 2/1937 | Salfisberg | 206/56 |
| 2,185,386 | 1/1940 | Valentine | 206/823 |
| 2,561,400 | 7/1951 | Morrell | 206/229 |
| 2,833,402 | 5/1958 | Lefebvre | 206/56 |
| 3,809,483 | 5/1974 | Young | 206/229 |
| 4,492,306 | 1/1985 | Cooper | 206/216 |
| 4,535,886 | 8/1985 | Salem | 206/205 |
| 4,637,712 | 1/1987 | Arnold et al. | 355/75 |
| 4,704,042 | 11/1987 | Eisen et al. | 402/79 |
| 4,747,782 | 5/1988 | Campbell, Jr. | 434/377 |
| 4,805,773 | 2/1989 | Sabongi | 206/823 |
| 4,824,143 | 4/1989 | Grainger | 132/317 |
| 4,848,378 | 7/1989 | Moir et al. | 132/319 |
| 4,876,136 | 10/1989 | Chang et al. | 206/823 |
| 4,890,872 | 1/1990 | Parrotta et al. | 206/823 |

*Primary Examiner*—Jimmy G. Foster
*Attorney, Agent, or Firm*—Arnold, White & Durkee

[57] ABSTRACT

Packaging for product samples and the like that is suitable for insertion into newspaper publications with standard automatic insertion machinery and provides non-bulging product sample protection when inserted into a newspaper publication to prevent "footballing" of newspaper stacks.

34 Claims, 7 Drawing Sheets

SAMPLE PACKET NEWSPAPER INSERT

FIELD OF THE INVENTION

The present invention relates to packaging for product samples suitable for use as a newspaper insert, and particularly to product sample packaging for use as a newspaper insert that is compatible with automated insertion equipment.

BACKGROUND OF THE INVENTION

It is often desirable to offer actual samples of a product, or various promotional articles, as part of advertisements incorporated into printed publications. In particular, it is desirable to provide product packaging that can be inserted into newspapers with standard automatic insertion machinery. It is also desirable that this packaging protect the product sample from being crushed when the newspapers are stacked on palettes. It is furthermore desirable that the packaging not create "footballing", or bulging, of the stacked newspapers. Such footballing causes the newspaper stack to be unstable and unduly concentrates the weight of the stacked papers on the inserted product samples.

Packaging according to the prior art is generally in the form of relatively thin pouches that are sealed along their edges. In one example, a relatively thin sealed pouch has a strip along one side suitable for binding between pages of a printed magazine.

Another example has a sheet member that wraps around a plurality of product sample packages to protect the product samples. The sheet member also has a strip along one side suitable for binding between pages of a printed magazine.

Although the two examples described above are suitable for binding in a printed magazine, they are not suitable for inserts for newspaper publications. This is because the automatic insertion machinery requires that the insert be substantially planar over its major surfaces, that it have a relatively blunt and rigid leading edge for insertion into the feed rolls for the insertion machinery, and that it have flexibility to bend around the surface of the feed rolls until feed into the feed bin of the insertion machinery.

Neither of the examples described above have leading edges suitable for automatic insertion purposes. Furthermore, they have no protection against crushing of the product samples that they package.

Still another example has a pouch that contains a rigid member to prevent the pouch contents from being excessively compressed by the stacking process. However, this example lacks the blunt, relatively rigid edge required for the automatic insertion machinery and the rigid member contained therein can interfere with the degree of flatness and flexibility required to properly pass through the feed rolls of the automatic insertion machinery.

OBJECTS OF THE INVENTION

Therefore, it is a primary object of the present invention to provide packaging for product samples and the like that is suitable for use as an insert for a newspaper publication.

It is another object of the invention to provide packaging for product samples that is suitable for automatic insertion machinery used for newspaper publications.

It is yet another object of the invention to provide product sample packaging that is relatively flat over its major surfaces and has a relatively blunt rigid leading edge for insertion into the feed rolls of automatic insertion equipment.

It is still another object of the invention to provide product sample packaging that has sufficient flexibility to follow the curvature of the surface of the feed rolls of the automatic insertion machinery.

It is a further object of the invention to provide product sample packaging that prevents a stack of newspapers containing inserts of the product samples from crushing the samples.

It is a still further object of the invention to provide product sample packaging that prevents a stack of newspapers containing inserts of the product samples from footballing.

Other objects and advantages of the present invention are realized as described below in connection with the detailed description of the preferred embodiment of the invention and recited in the appended claims.

SUMMARY OF THE INVENTION

The present invention achieves the above-described objects, as well as other objects and advantages, with a product sample package that contains a unilaterally flexible, substantially flat substrate having at least one aperture therethrough large enough to surround the product sample, or at least a substantial portion thereof. The package also has an outer sheath with at least one window therein to display the product sample, or at least a portion thereof.

The product sample is adhered to the inner surface of the outer sheath over the window and the substrate is adhered to the inner surface of the outer sheath so that its aperture surrounds the product sample, or at least a portion thereof. The outer sheath is folded over the substrate with the product sample therein to completely envelope the product sample and substrate. The open ends of the outer sheath are then sealed together.

The substrate has sufficient thickness to protect the product sample against crushing, as well as sufficient area to prevent footballing from occurring when the package is inserted into a newspaper. The edges of the outer sheath folded over the edges of the substrate provide a blunt, relatively rigid edge suitable for insertion into the feed rolls of automatic insertion equipment. The substrate also has sufficient flexibility to allow the package to conform to the curvature of the feed rolls.

DETAILED DESCRIPTION OF THE PREFERRED EMBODIMENT

Figure 1:
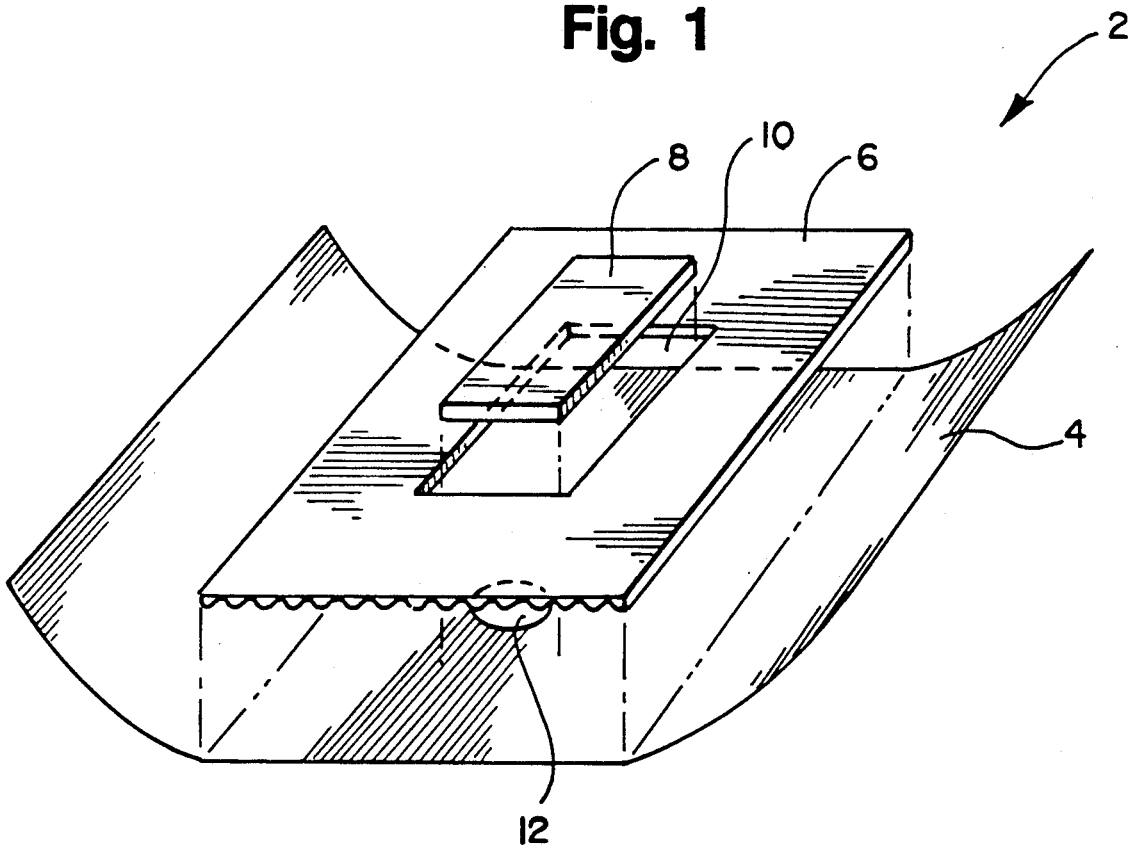
FIG. 1 is an exploded view of a preferred embodiment of the present invention.

Referring to the drawings, wherein reference characters represent like or corresponding parts throughout the views, FIG. 1 shows an exploded view of the preferred embodiment of the invention. The preferred embodiment comprises a sample product packet assembly 2 having an outer sheath 4 that envelopes a flexible substrate 6 and a product sample 8 nestled within an aperture 10 in the substrate 6.

The product sample 8 and the substrate 6 that surrounds it are aligned and fastened to the inner surface of the outer sheath 4 to expose at least a portion of the product sample 8 through a window 12 in the outer sheath 4. The product sample 8 and the substrate 6 are both fastened to the outer sheath with any convenient sealing means, such as with a thermobond or adhesive. The product sample 8 is most conveniently spot glued with an adhesive to aid later removal from the packet 2.

The outer sheath 4 may comprise any heavy duty wrapping material, such as thermoplastic film or heavy weight paper. Seventy pound kraft paper is preferred for this purpose. The outer surface of the outer sheath 4 may be printed as desired.

The substrate 6 may comprise any heavy duty, lightweight sheet material that has relative rigidity along its length parallel to the folds in the outer sheath 4 and flexibility along its width transverse to the folds in the outer sheath 4. To this end, the substrate 6 may comprise a splined or fluted material or lamination that has its splines or flutes arranged substantially parallel to the direction of the folds in the outer sheath 4. Alternatively, the substrate 6 may comprise a thermoplastic foam material.

The substrate 6 preferably has a thickness roughly approximating the thickness of the product sample 8. The sheet material comprising the substrate 6 may be folded over a number of times on itself to form a laminate having sufficient thickness to approximate the thickness of the product sample 8.

Single-faced, corrugated cardboard with type "A" fluting is preferred sheeting material for the substrate 6. The flutes should be substantially parallel to opposite sides of the substrate 6. The direction of the flutes is arranged to be parallel to the direction of the folds in the outer sheath 4.

The fluted side of the single-faced corrugated cardboard should be fastened to the inner surface of the outer sheath 4. The corrugated cardboard may be folded over upon itself any number of times to build up to a thickness approximating the thickness of the product sample 8.

The aperture 10 is cut through the substrate 6. It has dimensions that allow the product sample 8 to be placed within it. In the preferred embodiment, the aperture 10 has dimensions somewhat larger than those of the product sample 8 to allow automatic dispensing equipment to place the product sample 8 within the aperture 10.

Alternatively, the aperture 10 may be sized so that it slightly overlaps the product sample 8 along one edge of the product sample 8. In this case, the product sample 8 may be attached to the substrate 6 instead of the outer sheath 4 with suitable sealing means, such as with a thermobond or adhesive.

Of course, although only one of the apertures 10 with a single associated product sample 8 is shown in FIG. 1, any number of the apertures 10 can be cut into the substrate 6 to accept a plurality of the product samples 8. In this case, the apertures 10 may be of different sizes and shapes to accommodate different sizes and shapes of the product samples 8.

Figure 2:
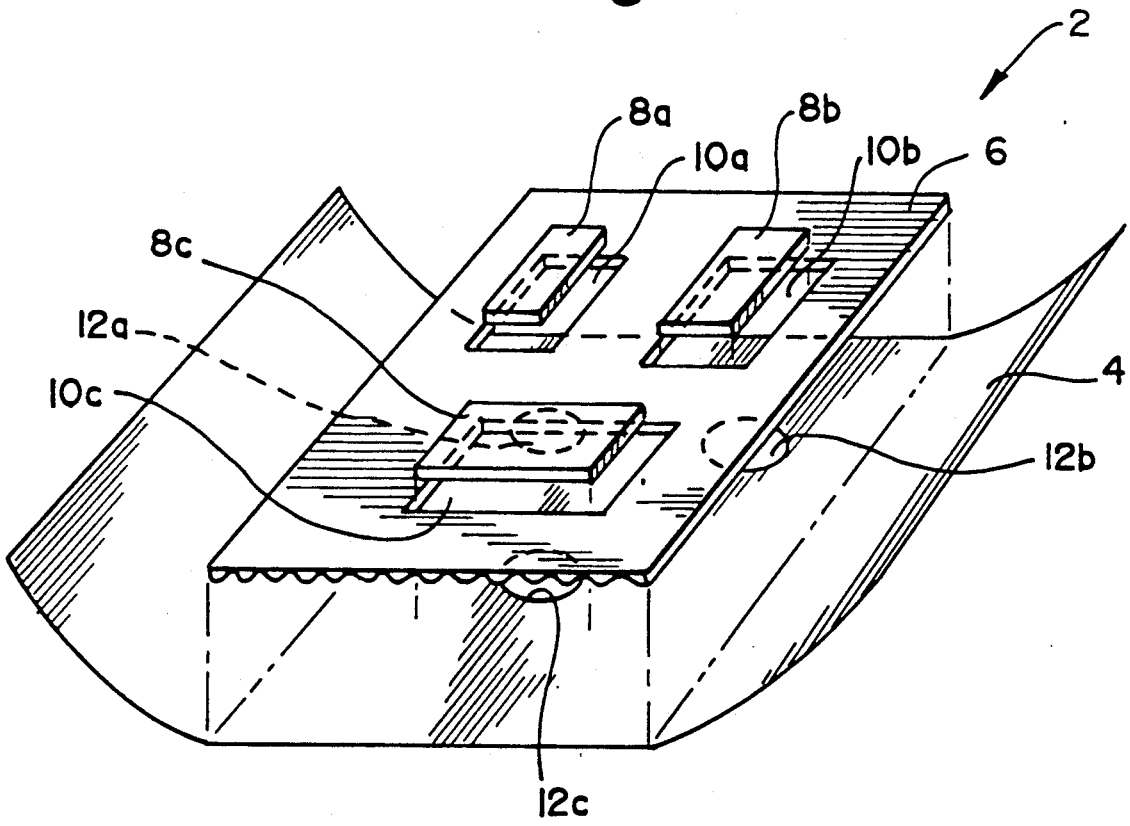
FIG. 2 is an exploded view of the preferred embodiment of the invention with a plurality of product samples.

FIG. 2 shows an exploded view of the packet 2 with three of the product samples 8, represented as the product samples 8*a*, 8*b* and 8*c*. Each of the product samples 8*a*, 8*b* and 8*c* have corresponding apertures 10*a*, 10*b* and 10*c*, as well as corresponding windows 12*a*, 12*b* and 12*c*.

The thickness of the substrate 6 should be thick enough to roughly approximate the thickness of the thickest one of the product samples 8. The apertures 10 should also be spaced from the edges of the substrate 6 parallel to the folds in the outer sheath 4 with a spacing wide enough to insure that the counting mechanism for the automatic insertion machinery functions properly.

Generally, accurate counting requires that the thickness of the product packet 2 along the edge inserted into the automatic insertion machinery have a uniform thickness along its length inward for at least an inch and a half. Therefore, a margin of approximately an inch and a half along these edges of the substrate 6 is recommended.

One of the windows 12 is provided for each of the product samples 8 nestled within the substrate 6. The windows 12 may comprise apertures or transparent regions in the outer sheath 4. Alternatively, the windows 12 may comprise apertures in the outer sheath 4 covered with transparent film, preferably along the inner surface of the outer sheath 4, such as a clear thermoplastic film or cellophane.

Simple apertures in the outer sheath 4 are generally preferred for the windows 12. It is important that the dimensions of the windows 12 be smaller than their associated product samples in this instance to insure that the product samples 8 are securely retained within the packet 2.

Figure 3:
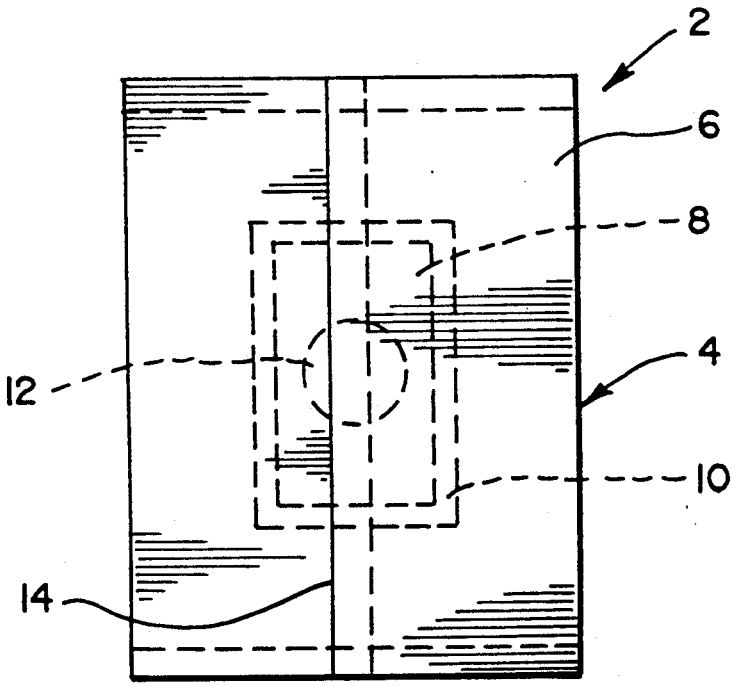
FIG. 3 is a rear view of the preferred embodiment of the present invention.

After the substrate 6 and product sample 8 are fastened to the inner surface of the outer sheath 4, the ends of the outer sheath 4 are wrapped around the substrate 6 and product sample 8 to completely envelope them as shown in FIG. 3. The folded ends overlap each other to form a seam 14 along the back surface of the substrate 6.

The seam 14 may or may not be sealed with a convenient sealing means, such as a thermobond or adhesive, depending upon the size and contents of the packet 2. The edges of the outer sheath 4 transverse to the seam 14 are then sealed with a convenient sealing means, such as a thermobond or adhesive, to completely seal the substrate 6 and the product sample 8 within the outer sheath 4.

Figure 4:
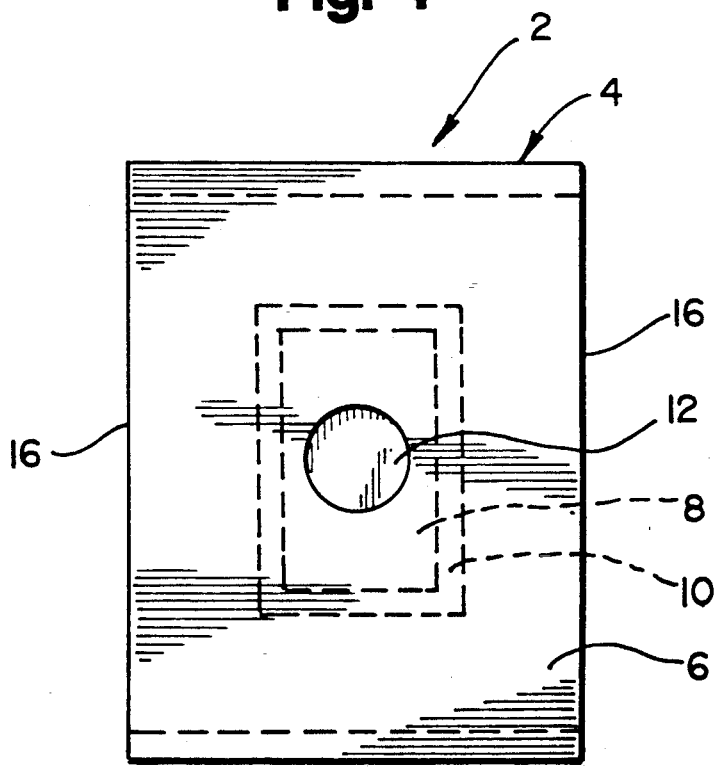
FIG. 4 is a front view of the preferred embodiment of the present invention.

FIG. 4 shows the front side of the assembled packet 2. The packet 2 has blunt, rigid edges 16 on two sides, corresponding to the folds in the outer sheath, suitable for insertion into the feed rolls of automatic insertion machinery.

Figure 5:
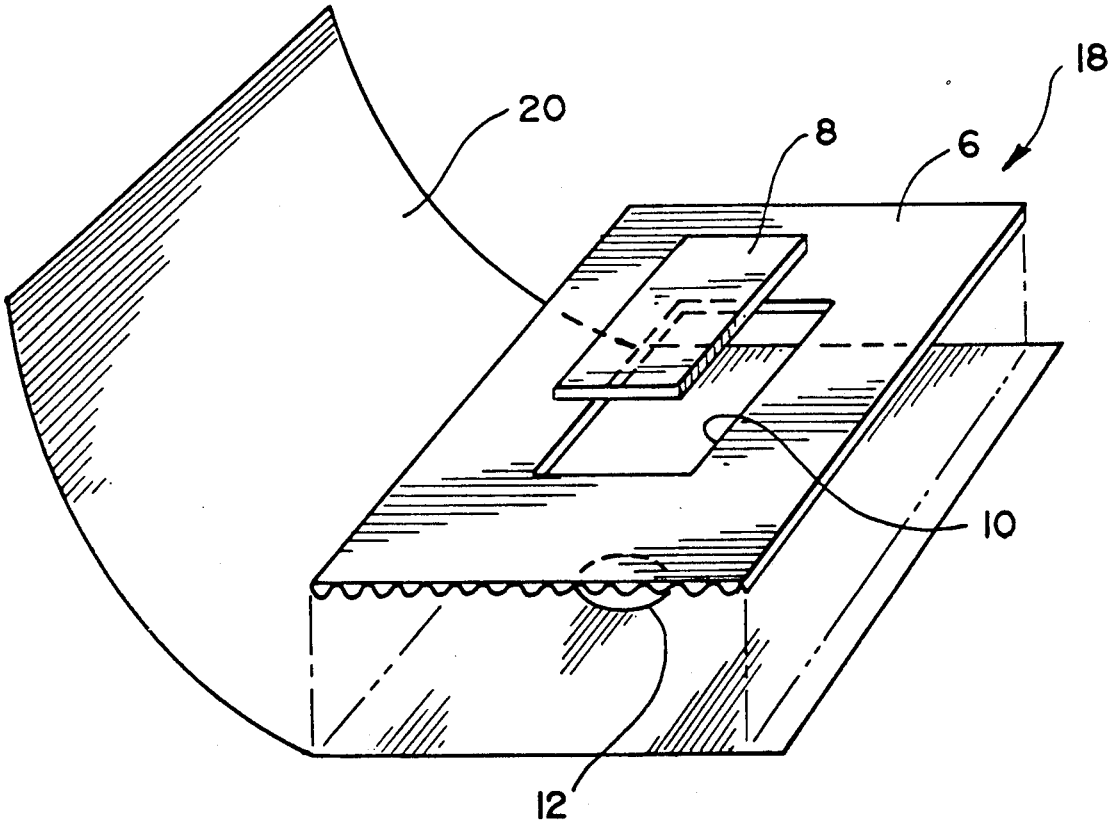
FIG. 5 is an exploded view of an alternate embodiment of the present invention.

FIG. 5 is an exploded view of an alternative embodiment of the invention. In this embodiment, a packet 18 has an outer sheath 20 with only one fold. The sheath 20 may comprise any of the suitable wrapping materials described above for the outer sheath 4.

The substrate 6 and the packet 8 are aligned over the window 12 along one side of the inner surface of the outer sheath 20 and fastened to the inner surface of the outer sheath 20 in a similar fashion as described above for the packet 2. Even though only one of the product samples 8 and one of the apertures 10 is shown for the packet 18 in FIG. 5, a plurality of the product samples 8 may be nestled within a plurality of the apertures 10 in the substrate 6, just as for the packet 2 described above.

Figure 6:
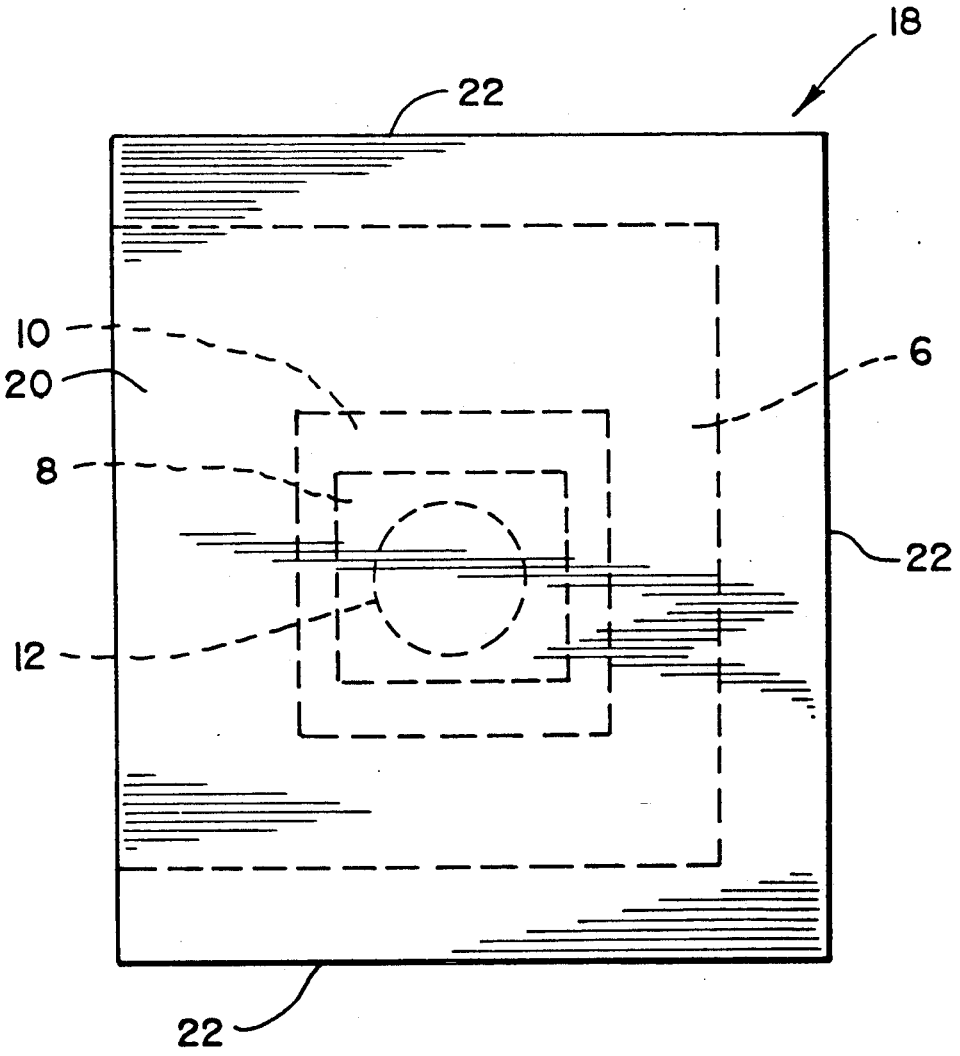
FIG. 6 is a rear view of the alternate embodiment of the present invention.

After the substrate 6 and product sample 8 are fastened to the inner surface of the outer sheath 20, the folded end of the outer sheath 20 is wrapped around the substrate 6 and product sample 8 to completely envelope them as shown in FIG. 6. The folded end of the outer sheath 20 completely covers the top of the substrate 6 and the product sample 8.

Figure 7:
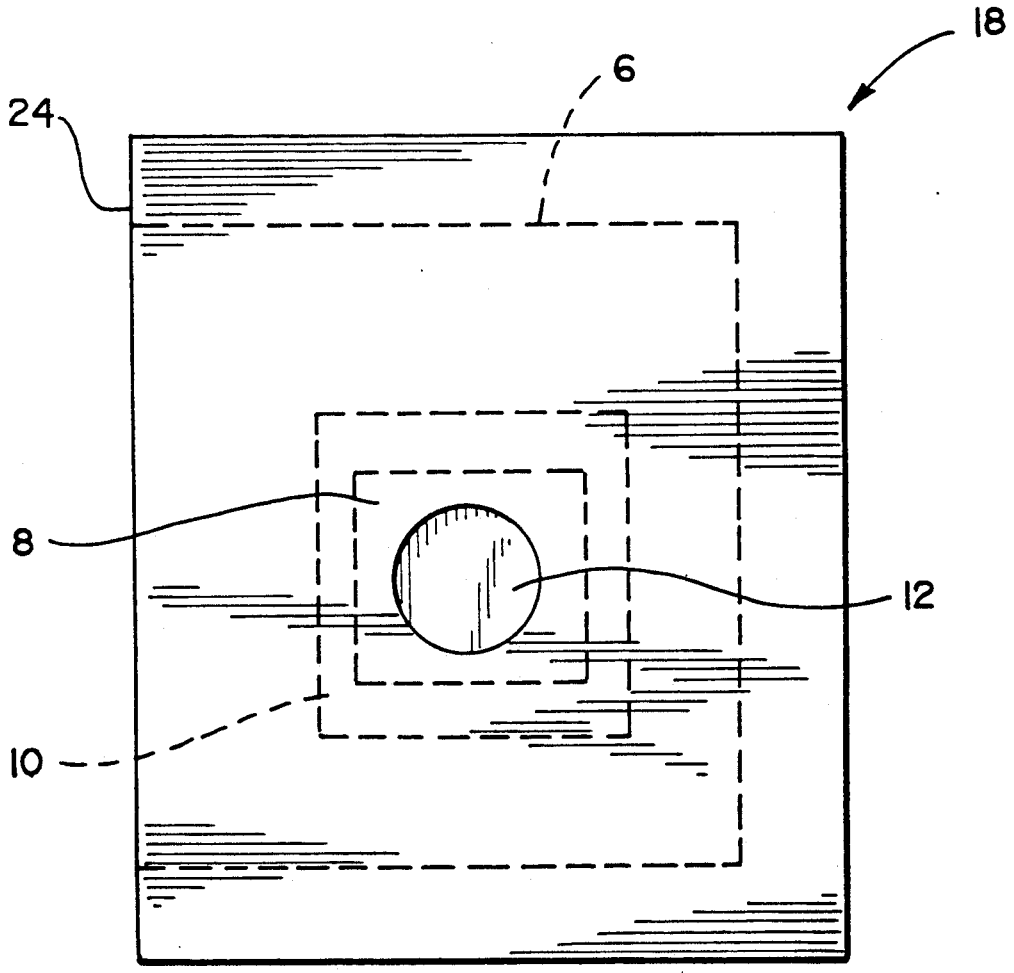
FIG. 7 is a front view of the alternate embodiment of the present invention.

The folded outer sheath 20 forms three edges 22. The edges 22 are sealed with any convenient sealing means, such as with a thermobond or adhesive material, to completely seal the product sample and substrate within the packet 18. A front side view of the assembled packet 18 is shown in FIG. 7.

Unlike the packet 2 described above, the packet 18 has only a single blunt rigid edge 24, corresponding to the single fold in the outer sheath 20, that is suitable for inserting into the feed rolls of automatic insertion machinery. The choice of embodiments, or variations thereof, depends on associated packet assembly requirements and machinery.

Thus, there has been described above packaging for product samples and the like that is suitable for insertion into newspaper publications with standard automatic insertion machinery and provides non-bulging product sample protection when inserted into a newspaper publication to prevent footballing of newspaper stacks. It will be understood that various changes in the details, arrangement of parts, and assembly procedures from those described above to explain the nature of the present invention may be made by those skilled in the art within the principle and scope of the present invention as expressed in the appended claims.

What is claimed is:

1. A package for a product sample suitable for insertion between pages of a printed publication and having a substantially uniform thickness, comprising:

a flexible, substantially planar substrate having a thickness approximating the thickness of a product sample and at least one aperture in said substrate nestling said product sample therein; and an outer sheath, wrapped around at least one edge of said substrate and in contact with said at least one edge, for completely enveloping said substrate and product sample, including at least one window for displaying at least a portion of said product sample.

2. The packaging recited in claim 1, wherein said product sample is spot glued to the inner surface of said outer sheath in alignment with said window in said sheath.

3. The packaging recited in claim 2, wherein said substrate is attached to the inner surface of said outer sheath with said aperture in said substrate nestling said product sample.

4. The packaging recited in claim 1, wherein said outer sheath folds around two edges of said substrate.

5. A package for a product sample suitable for insertion between pages of a printed publication and having a substantially uniform thickness, comprising:

a flexible, substantially planar substrate having a thickness approximating the thickness of a product sample and at least one aperture in said substrate nestling said product sample therein; and an outer sheath, wrapped around opposite edges of said substrate and in contact with both of said opposite edges, for completely enveloping said substrate and product sample, including at least one window for displaying at least a portion of said product sample.

6. The packaging recited in claim 5, wherein said product sample is spot glued to the inner surface of said outer sheath in alignment with said window in said sheath.

7. The packaging recited in claim 6, wherein said substrate is attached to the inner surface of said outer sheath with said aperture in said substrate nestling said product sample.

8. Packaging for a product sample suitable for insertion between pages of a printed publication, comprising:

a flexible, substantially planar substrate comprising a corrugated material with flutes substantially parallel to opposite edges of said substrate and having a thickness approximating the thickness of a product sample and at least one aperture in said substrate nestling said product sample therein; and an outer sheath, wrapped around said opposite edges of said substrate, for completely enveloping said substrate and product sample, including at least one window for displaying at least a portion of said product sample.

9. The packaging recited in claim 8, wherein said substrate further comprises single-sided corrugated cardboard with type "A" flutes.

10. The package recited in claim 9, wherein said substrate further comprises folds of said corrugated cardboard folded upon itself to form a laminate of said corrugated cardboard.

11. The package recited in claim 10, wherein said outer sheath comprises seventy pound weight kraft paper.

12. The packaging recited in claim 8, wherein said product sample is spot glued to the inner surface of said outer sheath in alignment with said window in said sheath.

13. The packaging recited in claim 12, wherein said substrate is attached to the inner surface of said outer sheath with said aperture in said substrate nestling said product sample.

14. A package for a product sample suitable for insertion between pages of a printed publication, comprising:

a flexible, substantially planar substrate having a thickness approximating the thickness of a product sample and at least one aperture in said substrate nestling said product sample therein;

an outer sheath, wrapped around at least one edge of said substrate, for completely enveloping said substrate and product sample, including at least one window for displaying at least a portion of said product sample; and said substrate comprising a fluted material having flutes substantially parallel to the direction of the fold of said outer sheath.

15. The package recited in claim 14, wherein said substrate further comprises folds of said fluted material upon itself to form a laminate of said fluted material.

16. The package recited in claim 14, wherein said substrate comprises a fluted thermoplastic sheet.

17. The package recited in claim 14, wherein said substrate comprises corrugated cardboard.

18. The package recited in claim 17, wherein said corrugated cardboard is single sided, with type "A" flutes.

19. The package recited in claim 14, wherein said outer sheath comprises a thermoplastic sheet.

20. The packaging recited in claim 14, wherein said outer sheath comprises wrapping paper.

21. The package recited in claim 20, wherein said wrapping paper comprises seventy pound weight kraft paper.

22. The package recited in claim 14, wherein said product sample is spot glued to the inner surface of said outer sheath in alignment with said window in said sheath.

23. The package recited in claim 22, wherein said substrate is attached to the inner surface of said outer sheath with said aperture in said substrate nestling said product sample.

24. The package recited in claim 14, wherein said outer sheath folds around two edges of said substrate.

25. A package for a product sample suitable for insertion between pages of a printed publication, comprising:

a flexible, substantially planar substrate having a thickness approximating the thickness of a product sample and at least one aperture in said substrate nestling said product sample therein;

an outer sheath, wrapped around opposite edges of said substrate, for completely enveloping said substrate and product sample, including at least one window for displaying at least a portion of said product sample; and said substrate comprising a fluted material having flutes substantially parallel to the direction of the fold of said outer sheath.

26. The package recited in claim 25, wherein said substrate further comprises folds of said fluted material upon itself to form a laminate of said fluted material.

27. The package recited in claim 25, wherein said comprises a fluted thermoplastic sheet.

28. The package recited in claim 25, wherein said substrate comprises corrugated cardboard.

29. The package recited in claim 28, wherein said corrugated cardboard is single sided, with type "A" flutes.

30. The package recited in claim 25, wherein said outer sheath comprises a thermoplastic sheet.

31. The package recited in claim 25, wherein said outer sheath comprises wrapping paper.

32. The package recited in claim 31, wherein said wrapping paper comprises seventy pound weight kraft paper.

33. The package recited in claim 25, wherein said product sample is spot glued to the inner surface of said outer sheath in alignment with said window in said sheath.

34. The package recited in claim 33, wherein said substrate is attached to the inner surface of said outer sheath with said aperture in said substrate nestling said product sample.

* * * * *